US009497539B2

(12) United States Patent
Okita

(10) Patent No.: US 9,497,539 B2
(45) Date of Patent: Nov. 15, 2016

(54) VARIABLE DIRECTIONAL MICROPHONE

(75) Inventor: Shioto Okita, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 1306 days.

(21) Appl. No.: 13/064,127

(22) Filed: Mar. 8, 2011

(65) Prior Publication Data

US 2011/0235821 A1 Sep. 29, 2011

(30) Foreign Application Priority Data

Mar. 23, 2010 (JP) ..... 2010-066093

(51) Int. Cl.

| | |
|---|---|
| ***H04R 3/00*** | (2006.01) |
| ***H04R 1/40*** | (2006.01) |
| ***H04R 1/24*** | (2006.01) |
| *H04R 1/28* | (2006.01) |
| *H04R 9/08* | (2006.01) |

(52) U.S. Cl.

CPC ..... *H04R 1/406* (2013.01); *H04R 1/245* (2013.01); *H04R 1/2807* (2013.01); *H04R 3/005* (2013.01); *H04R 9/08* (2013.01)

(58) Field of Classification Search

CPC .. H04R 3/005; H04R 5/027; H04R 2410/01; H04R 19/04; H04R 1/406

USPC ..... 381/92, 111–115, 122

See application file for complete search history.

(56) References Cited

U.S. PATENT DOCUMENTS 4,399,327 A * 8/1983 Yamamoto ..... G11B 23/037 352/25

5,862,240 A * 1/1999 Ohkubo ..... H04R 1/406 381/122

FOREIGN PATENT DOCUMENTS

JP S59-064994 A 4/1984

JP S59-200599 A 11/1984

OTHER PUBLICATIONS

Japan Patent Office, "Office Action for JP 2010-066093," Oct. 9, 2013.

* cited by examiner

*Primary Examiner* — George Monikang

(74) *Attorney, Agent, or Firm* — Manabu Kanesaka

(57) ABSTRACT

There is provided a variable directional microphone including dynamic microphone units that is small in size and has good directional frequency response. In a variable directional microphone 1A in which a unidirectional first dynamic microphone unit (front-side unit) 1F and a second dynamic microphone unit (rear-side unit) 1R, which has substantially the same configuration as that of the front-side unit 1F and is provided with an output adjusting means of sound signal, are provided as a pair; the front-side unit 1F and the rear-side unit 1R are arranged coaxially so that the directivity axes thereof are directed to the directions 180° opposite to each other; and the output signals of the front-side unit 1F and the rear-side unit 1R are generated via a signal synthesis circuit, one rear air chamber 1*b* is used in common by the front-side unit 1F and the rear-side unit 1R.

2 Claims, 10 Drawing Sheets

VARIABLE DIRECTIONAL MICROPHONE

CROSS-REFERENCE TO RELATED APPLICATION

The present application is based on, and claims priority from, Japanese Application Serial Number JP2010-066093, filed Mar. 23, 2010, the disclosure of which is hereby incorporated by reference herein in its entirety.

TECHNICAL FIELD

The present invention relates to a variable directional microphone. More particularly, it relates to a variable directional microphone configured by two unidirectional dynamic microphone units.

BACKGROUND ART

By synthesizing sound signals generated from two microphone units by using a variable directional microphone configured by the two microphone units, directivity such as omnidirectivity, cardioid, hypercardioid, or bidirectivity can be obtained selectively.

In this case, as both of the two microphone units, unidirectional microphone units are used, and the microphone units are arranged coaxially so that the directivity axes thereof are directed to the directions opposite to each other (180° directions) (for example, refer to Patent Document 1 (Japanese Patent Application Publication No. 2005-184347)).

Therefore, as the microphone unit, a small-size unidirectional condenser microphone has been used frequently, and a dynamic microphone unit has scarcely been used because of its large size.

The reason why the dynamic microphone unit is large in size is that a rear air chamber is needed to obtain an omnidirectional component regardless of whether it is omnidirectional or unidirectional. FIG. 10A is a sectional view showing the schematic configuration of the dynamic microphone unit, and FIG. 10B is an equivalent circuit diagram of the dynamic microphone unit shown in FIG. 10A.

As shown in FIG. 10A, a dynamic microphone unit 1 includes, as a basic configuration, an electrokinetic acousto-electric converter 1*a* and a rear air chamber 1*b*.

The electrokinetic acousto-electric converter 1*a* has a diaphragm 10 having a voice coil 11 and a magnetic circuit section 20 having a magnetic gap 21 in which the voice coil 11 are oscillatably arranged. The magnetic circuit section 20 is housed in a cylindrical unit holder 30. The diaphragm 10 is supported on a peripheral edge portion of an enlarged-diameter flange part 31 of a unit holder 20.

Since this dynamic microphone unit 1 is unidirectional, the flange part 31 is provided with a bidirectional component intake port (rear acoustic terminal) 32 communicating with a front air chamber 12 existing on the back surface side of the diaphragm 10. In the case where the dynamic microphone unit 1 is omnidirectional, the bidirectional component intake port 32 is not provided.

The rear air chamber 1*b* is formed by a substantially enclosed unit case 40 mounted on the rear end side of the unit holder 30. The front air chamber 12 on the diaphragm 10 side and the rear air chamber 1*b* are connected acoustically to each other via a sound wave passage in the unit holder 30. In the sound wave passage, a predetermined acoustic resistance material 33 is provided.

In the equivalent circuit diagram of FIG. 10B, P denotes a front sound source, $Pe^{-jkd\cos\theta}$ denotes a rear sound source, $m_0$ and $S_0$ denote the mass and stiffness of the diaphragm 10, respectively, $S_1$ denotes the stiffness of the front air chamber 12, $r_0$ and $m_1$ denote the resistance and mass of the bidirectional component intake port 32, respectively, $r_1$ denotes the braking resistance of the acoustic resistance material 33, and $S_2$ denotes the stiffness of the rear air chamber 1*b*.

The low frequency limit in the frequency characteristics is mainly determined by the mass and compliance ($1/S_0$) of the diaphragm 10. However, in the case where the capacity Ca of the rear air chamber 1*b* is low, the low frequency limit is affected. Therefore, in the dynamic microphone unit 1, the capacity Ca of the rear air chamber 1*b* must be increased. Accordingly, the external dimensions of the dynamic microphone unit 1 become far larger than those of the condenser microphone unit. The large capacity Ca of the rear air chamber 1*b* exerts an influence on a low frequency (omnidirectional component) only, and scarcely exerts an influence on the frequency band (bidirectional component) in which the unidirectivity is obtained.

In the case where the variable directional microphone is configured by a pair of above-described dynamic microphone units 1, a series mode in which the two dynamic microphone units 1 are arranged coaxially in a back-to-back form as shown in FIG. 11A and a parallel mode in which the rear air chambers 1*b* of the two dynamic microphone units 1 are lapped on each other as shown in FIG. 11B are conceivable.

In the series mode shown in FIG. 11A, unfortunately, the overall length becomes double the length of the dynamic microphone unit 1, and accordingly the distance between the acoustic terminals of the dynamic microphone units 1 also increases. Therefore, there arises a problem that the difference (phase difference) between arrival times of sound waves to the acoustic terminals from the sound source increases, so that turbulence is easily produced especially in a high sound range.

In contrast, according to the parallel mode shown in FIG. 11B, the overall length can be shortened as compared with the series mode. However, the acoustic terminals of the dynamic microphone units 1 are arranged asymmetrically in the right-and-left direction. Therefore, there arises a problem of deteriorated directional frequency response.

Accordingly, an object of the present invention is to provide a variable directional microphone including dynamic microphone units that is small in size and has good directional frequency response.

SUMMARY OF THE INVENTION

To achieve the above object, the present invention provides a variable directional microphone in which a unidirectional first dynamic microphone unit and a second dynamic microphone unit, which has substantially the same configuration as that of the first dynamic microphone unit and is provided with an output adjusting means of sound signal, are provided as a pair; the first and second dynamic microphone units are arranged coaxially so that the directivity axes thereof are directed to directions 180° opposite to each other; and the output signals of the dynamic microphone units are generated via a signal synthesis circuit, wherein one rear air chamber that is used in common by the first and second dynamic microphone units is provided between the first and second dynamic microphone units.

According to the present invention, in arranging the first and second dynamic microphone units coaxially so that the directivity axes thereof are directed to the directions 180° opposite to each other, one rear air chamber that is used in common by these microphone units is provided between the first and second dynamic microphone units. Thereby, the length of the microphone can be shortened by at least the length of one rear air chamber, and good directional frequency response can be obtained.

The present invention also embraces a mode in which the rear air chamber is arranged on an outside between the dynamic microphone units via a predetermined tube member.

By arranging the rear air chamber on the outside between the dynamic microphone units via the predetermined tube member, the distance between acoustic terminals (distance between diaphragms of the units) is shortened, so that better directional frequency response can be obtained.

DETAILED DESCRIPTION

Embodiments of the present invention will now be described with reference to FIGS. 1 to 3. The present invention is not limited to the embodiments described below.

First, a variable directional microphone 1A in accordance with a first embodiment of the present invention is explained with reference to FIG. 1. This variable directional microphone 1A includes two unidirectional dynamic microphone units 1F and 1R.

In this embodiment, one dynamic microphone unit 1F is a front-side unit that is directed to the sound source side when sound is picked up. In contrast, the other dynamic microphone unit 1R is a rear-side unit that is directed to the rear with respect to the sound source. In the following explanation, one dynamic microphone unit 1F is sometimes referred simply to as a "front-side unit 1F", and the other dynamic microphone unit 1R is sometimes referred simply to as a "rear-side unit 1R".

The front-side unit 1F and the rear-side unit 1R have substantially the same configuration, and each are provided with an electrokinetic acousto-electric converter 1*a* that is similar to that explained before with reference to FIG. 10A.

Figure 10A:
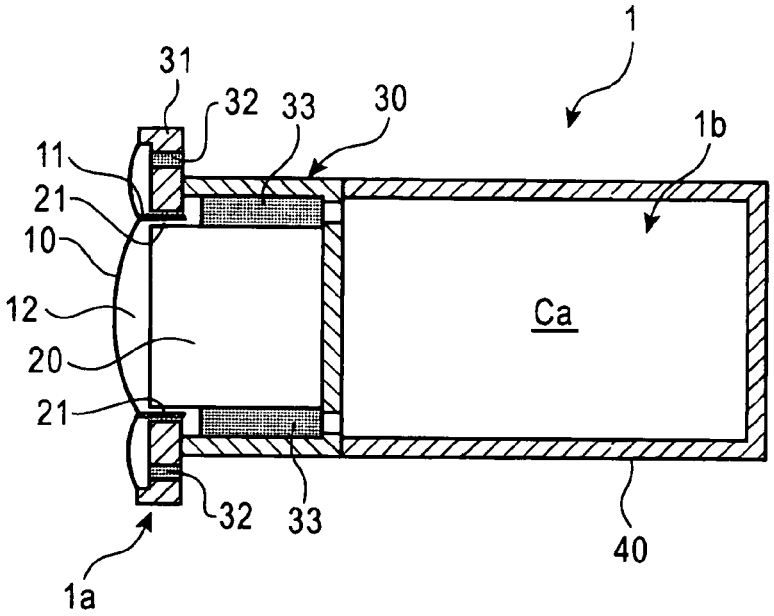
FIG. 10A RELATED ART
FIG. 10A is a schematic sectional view showing a basic configuration of a conventional unidirectional dynamic microphone unit.
Figure 10B:
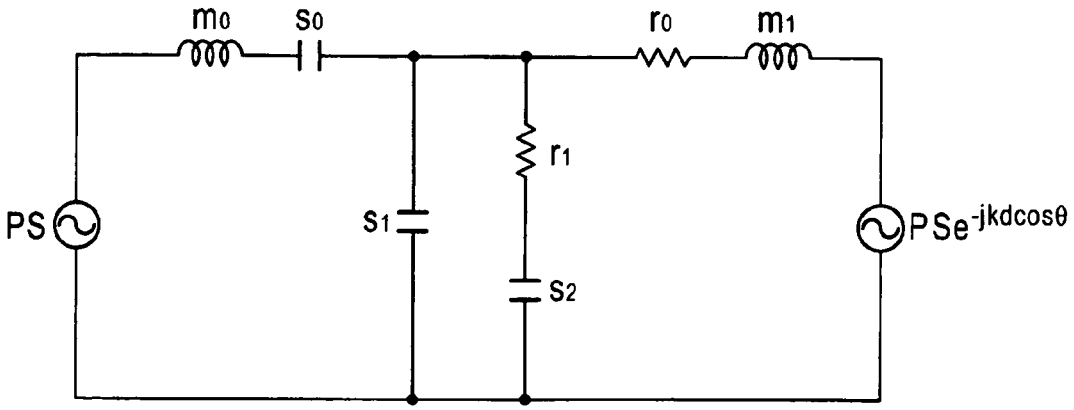
FIG. 10B RELATED ART
FIG. 10B is an equivalent circuit diagram of the dynamic microphone unit shown in FIG. 10A.

That is, referring to FIG. 10A, the electrokinetic acousto-electric converter 1*a* is configured so that a diaphragm 10 having a voice coil 11 and a magnetic circuit section 20 having a magnetic gap 21 are supported by the unit holder 30, and a flange part 31 of the unit holder 30 is provided with a bidirectional component intake port (rear acoustic terminal) 32 communicating with a front air chamber 12 existing on the back surface side of the diaphragm 10.

The electrokinetic acousto-electric converter 1*a* of the front-side unit 1F and the electrokinetic acousto-electric converter 1*a* of the rear-side unit 1R are arranged coaxially so that the directivity axes thereof are directed to the directions 180° opposite to each other. In the variable directional microphone 1A in accordance with the first embodiment, the electrokinetic acousto-electric converters 1*a* are connected coaxially to each other via a cylindrical connecting cylinder 41 consisting of a straight tube, and a space in the connecting cylinder 41 is used in common as a rear air chamber 1*b* of the front-side unit 1F and the rear-side unit 1R.

The capacity Ca of the rear air chamber 1*b* in the connecting cylinder 41 may be approximately equal to the capacity Ca of the rear air chamber 1*b* explained before with reference to FIG. 10A considering the low frequency limit required by per one dynamic microphone unit. The connecting cylinder 41 is formed of a metallic material or synthetic resin material that is less liable to be deformed by an external force.

Figure 11A:
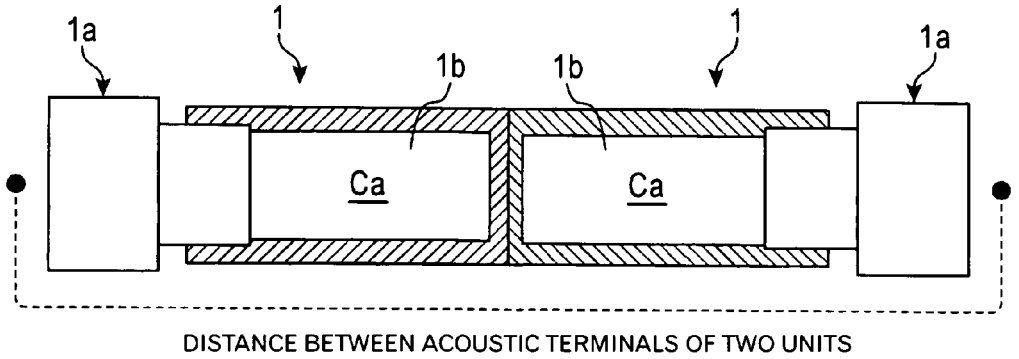
FIG. 11A RELATED ART
FIG. 11A is a schematic view showing a first imaginary mode of a variable directional microphone using the dynamic microphone units shown in FIG. 10A as a pair.
Figure 11B:
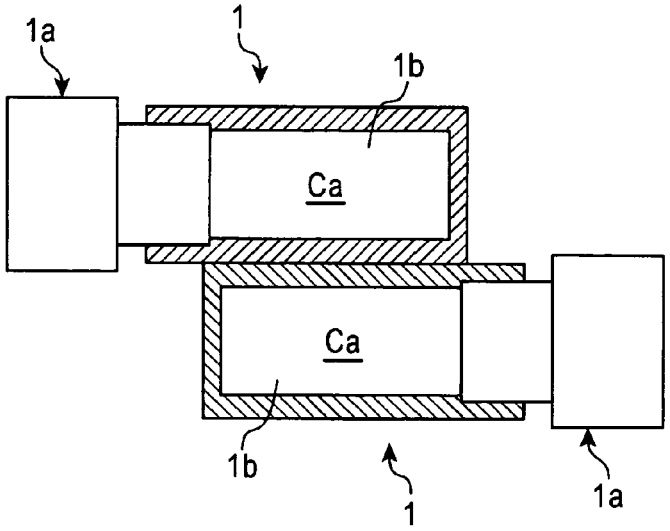
FIG. 11B RELATED ART
FIG. 11B is a schematic view showing a second imaginary mode of FIG. 11A.

According to the variable directional microphone 1A in accordance with the first embodiment, the rear air chamber 1*b* required by the front-side unit 1F and the rear-side unit 1R is used in common by the front-side unit 1F and the rear-side unit 1R. Therefore, the distance between the acoustic terminals (the distance between the diaphragms) of the front-side unit 1F and the rear-side unit 1R can be shortened by at least the length of one rear air chamber as compared with the first imaginary mode of series mode shown in FIG. 11A.

Next, a variable directional microphone 1B in accordance with a second embodiment is explained with reference to FIG. 2. In this variable directional microphone 1B, to further shorten the distance between the acoustic terminals of the front-side unit 1F and the rear-side unit 1R, the rear air chamber 1*b* used in common by the front-side unit 1F and the rear-side unit 1R is disposed on the outside between the units.

In this second embodiment, therefore, as a connecting cylinder for coaxially connecting the electrokinetic acousto-electric converters 1*a* of the front-side unit 1F and the rear-side unit 1R to each other, a connecting cylinder 42 that is shorter than the connecting cylinder 41 in the first embodiment is used.

The connecting cylinder 42 is integrally formed with an air chamber housing 44 connected to the connecting cylinder 42 between the electrokinetic acousto-electric converters 1*a* via a tube part 43. In this case, the sum of the capacity in the air chamber housing 44, the capacity in the tube part 43, and the capacity between the electrokinetic acousto-electric converters 1*a* is made equal to the capacity Ca of the rear air chamber 1*b* in the first embodiment.

According to the configuration of the variable directional microphone 1B of the second embodiment, the distance between the acoustic terminals of the front-side unit 1F and the rear-side unit 1R can be shortened further while the electrokinetic acousto-electric converters 1*a* of the front-side unit 1F and the rear-side unit 1R are arranged coaxially.

Figure 3:
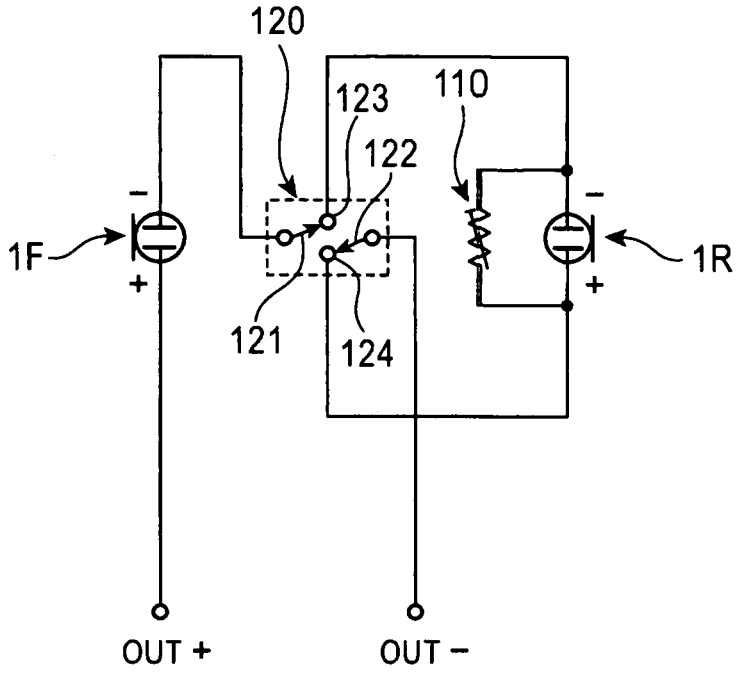
FIG. 3 is a circuit diagram for making the directivity variable.

The above-described variable directional microphones 1A and 1B each include an output level adjustment circuit 110 and a signal synthesis circuit 120 shown in FIG. 3. The output level adjustment circuit 110 consists of a variable resistor, and is provided in the rear-side unit 1R.

The signal synthesis circuit 120 is an addition/subtraction switching switch having first and second movable elements 121 and 122 and first and second fixed contacts 123 and 124.

The proximal end of the first movable element 121 is connected to the (−) side of the front-side unit 1F, and the proximal end of the second movable element 122 is connected to the minus-side output terminal OUT(−) of the signal synthesis circuit 120.

Also, the first fixed contact 123 is connected to the (−) side of the rear-side unit 1R, and the second fixed contact 124 is connected to the (+) side of the rear-side unit 1R. The (+) side of the front-side unit 1F is connected to the plus-side output terminal OUT(+) of the signal synthesis circuit 120.

Figure 4A:
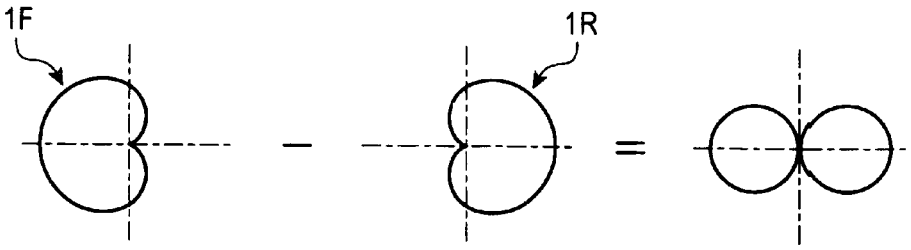
FIGS. 4A to 4E are polar pattern diagrams illustrating the directivities obtained by the present invention.

If a connecting state shown in FIG. 3, in which the first movable element 121 is connected to the first fixed contact 123 side, and the second movable element 122 is connected to the second fixed contact 124 side, is formed, the sound signal of the front-side unit 1F and the sound signal of the rear-side unit 1R are subtracted from each other. In this state, by making the resistance value (level attenuation factor) of the output level adjustment circuit 110 substantially zero, the bidirectivity as shown in FIG. 4A is obtained.

Figure 4B:
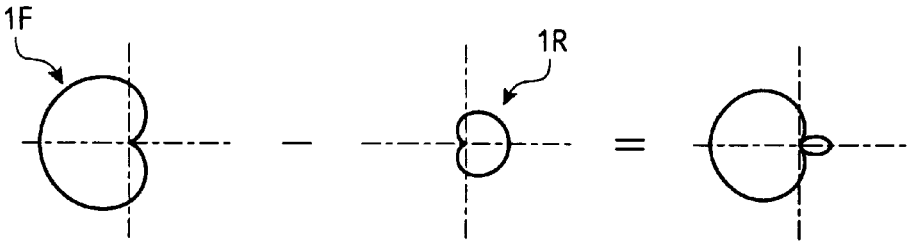

In the connecting state shown in FIG. 3, if the level of sound signal of the rear-side unit 1R is attenuated with the resistance value of the output level adjustment circuit 110 being a predetermined value, the directivity of hypercardioid as shown in FIG. 4B is obtained.

Figure 4C:
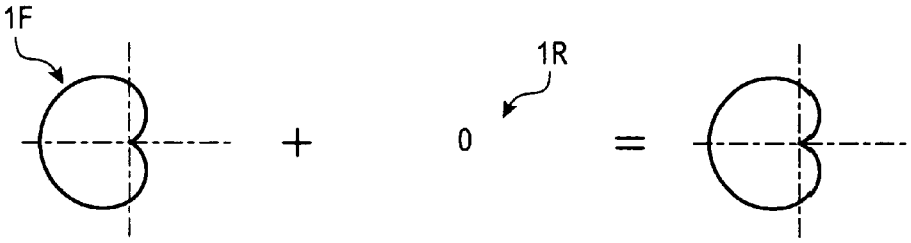

Also, from the connecting state shown in FIG. 3, the first movable element 121 is switched to the second fixed contact 124 side, whereby both the first movable element 121 and the second movable element 122 are connected to the second fixed contact 124. Thereby, the sound signal of the rear-side unit 1R is made zero. Therefore, by the sound signal of the front-side unit 1F only, the directivity of cardioid as shown in FIG. 4C is obtained. In the connecting state shown in FIG. 3, if the resistance value of the output level adjustment circuit 110 is raised, and thereby the sound signal of the rear-side unit 1R is made substantially zero, too, the directivity of cardioid as shown in FIG. 4C is obtained.

Figure 4D:
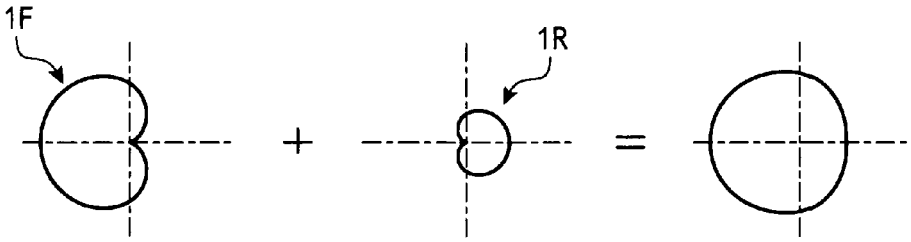

Also, the first movable element 121 is switched to the second fixed contact 124 side, and the second movable element 122 is switched to the first fixed contact 123 side. Thereby, the sound signal of the front-side unit 1F and the sound signal of the rear-side unit 1R are added to each other. If the level of sound signal of the rear-side unit 1R is attenuated with the resistance value of the output level adjustment circuit 110 being a predetermined value in this state, the directivity of subcardioid as shown in FIG. 4D is obtained.

Figure 4E:
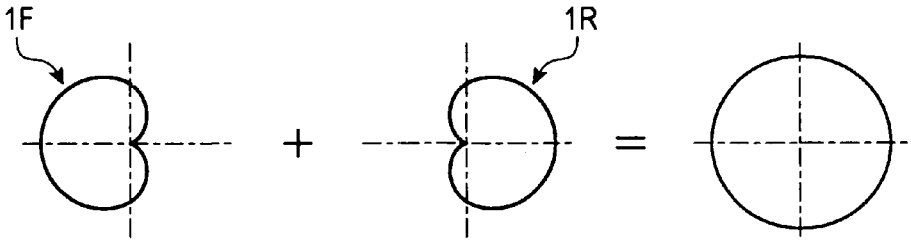

In this adding state, by making the resistance value (level attenuation factor) of the output level adjustment circuit 110 substantially zero, the omnidirectivity as shown in FIG. 4E is obtained.

Figure 1:
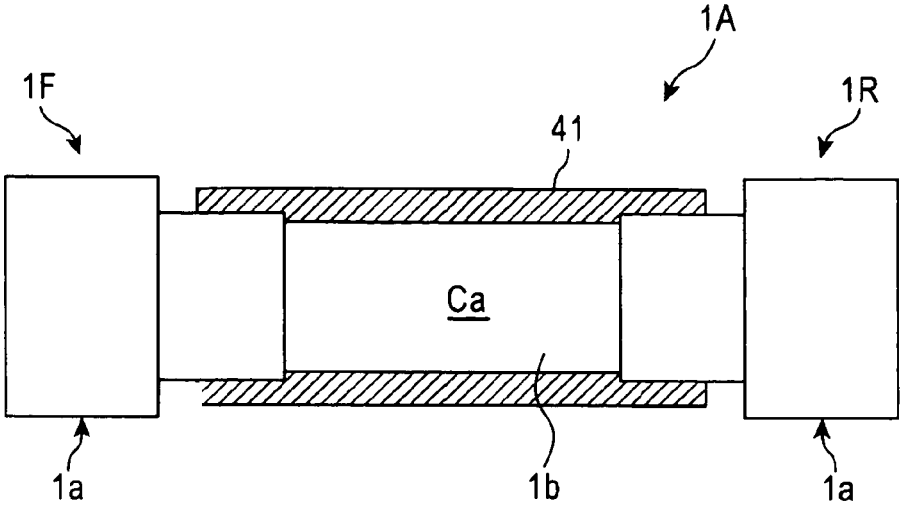
FIG. 1 is a schematic sectional view showing a first embodiment of the present invention.
Figure 2:
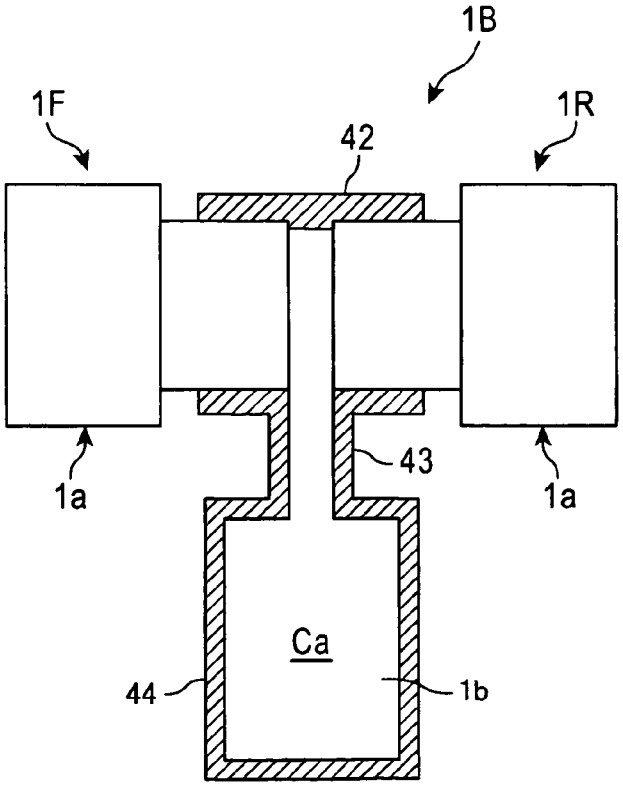
FIG. 2 is a schematic sectional view showing a second embodiment of the present invention.

An actual machine of the variable directional microphone in accordance with the mode of the first embodiment shown in FIG. 1 was prepared, and the output level adjustment circuit 110 and the signal synthesis circuit 120 were operated, whereby the directivities shown in FIGS. 4A to 4E were observed by polar pattern diagrams in accordance with the actual measurement data and graphs showing directional frequency response. The results are shown in FIGS. 5 to 9.

Figure 5A:
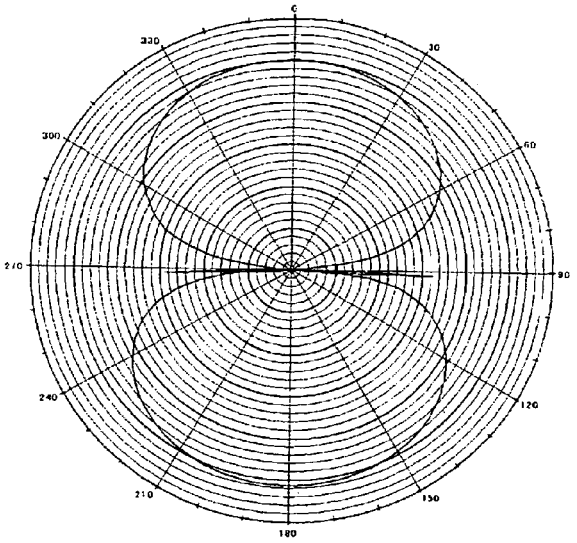
FIG. 5A is a polar pattern diagram in accordance with actual measurement data in the case where directivity is made bidirectivity in the present invention.
Figure 5B:
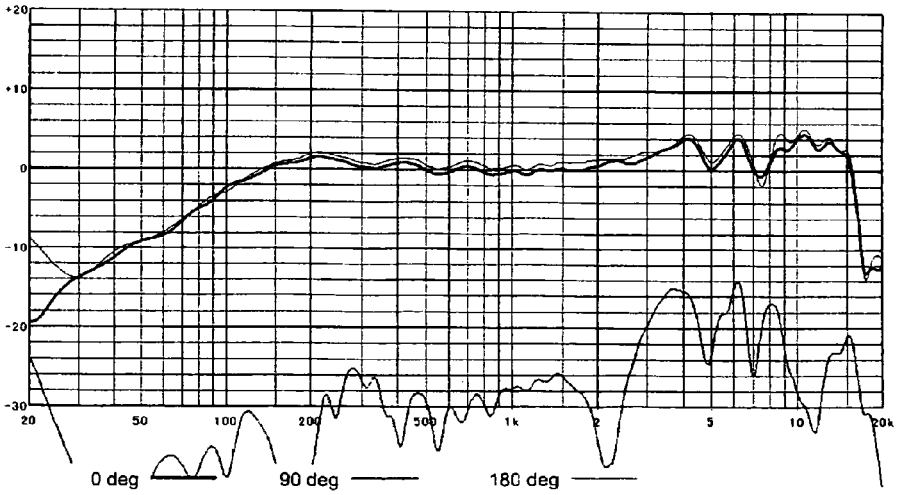
FIG. 5B is a graph showing the directional frequency response of FIG. 5A.
Figure 6A:
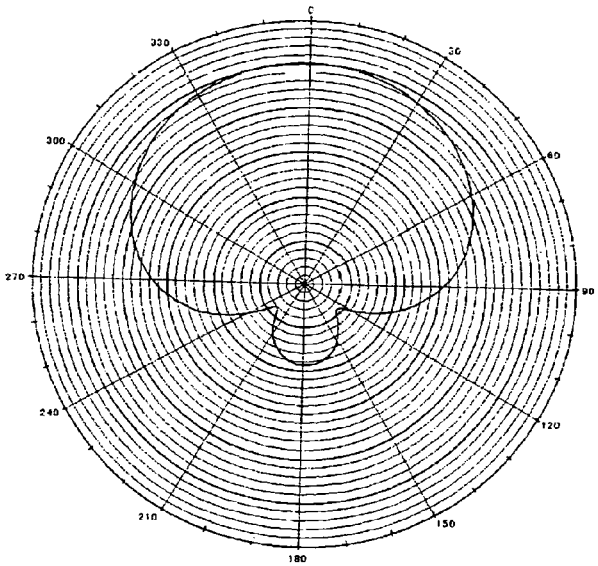
FIG. 6A is a polar pattern diagram in accordance with actual measurement data in the case where directivity is made hypercardioid in the present invention.
Figure 6B:
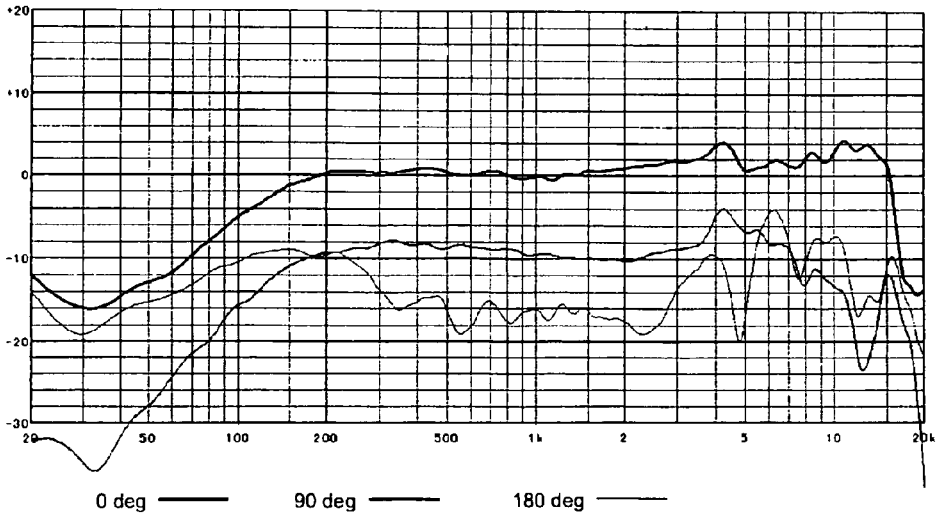
FIG. 6B is a graph showing the directional frequency response of FIG. 6A.
Figure 7A:
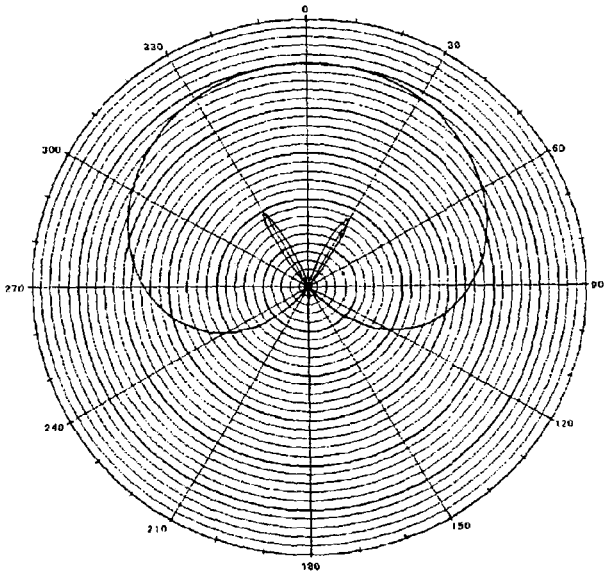
FIG. 7A is a polar pattern diagram in accordance with actual measurement data in the case where directivity is made cardioid in the present invention.
Figure 7B:
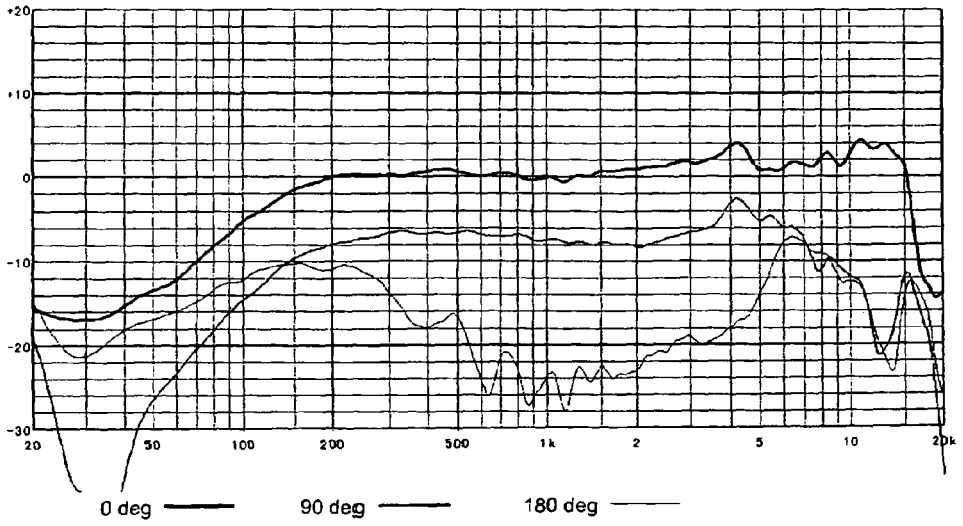
FIG. 7B is a graph showing the directional frequency response of FIG. 7A.
Figure 8A:
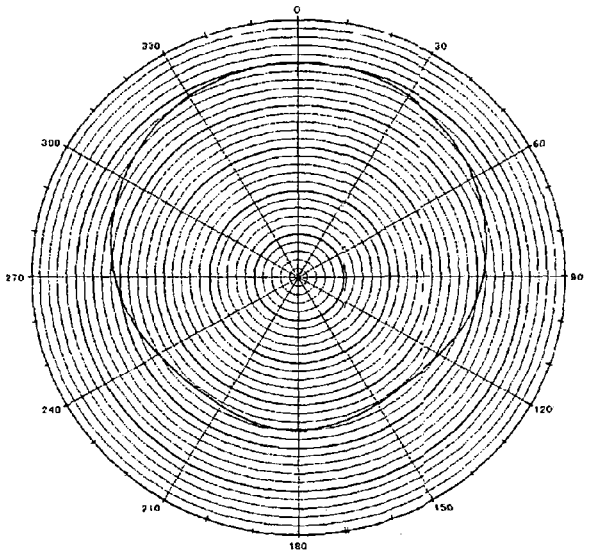
FIG. 8A is a polar pattern diagram in accordance with actual measurement data in the case where directivity is made subcardioid in the present invention.
Figure 8B:
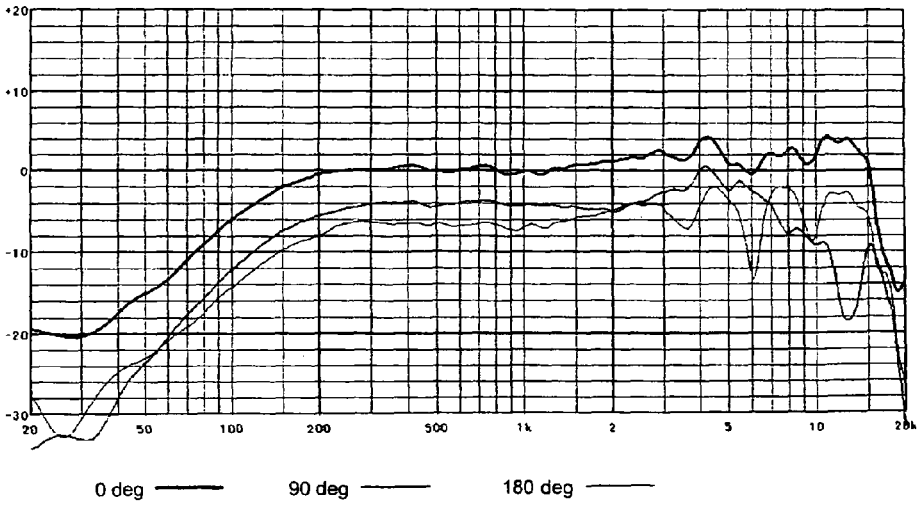
FIG. 8B is a graph showing the directional frequency response of FIG. 8A.
Figure 9A:
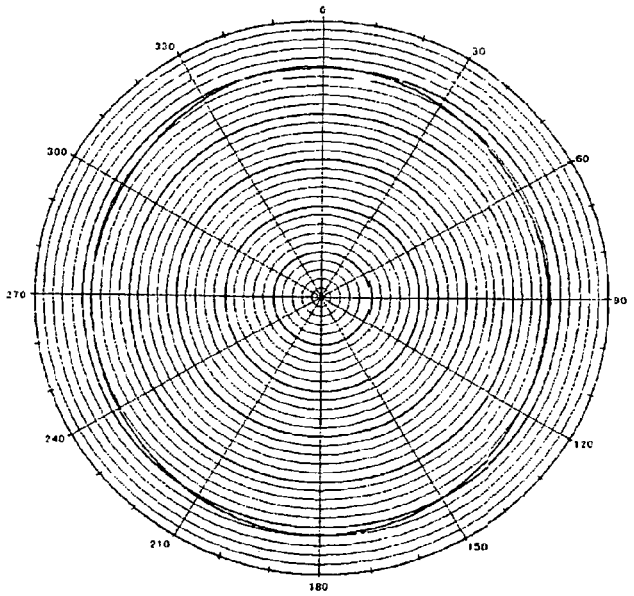
FIG. 9A is a polar pattern diagram in accordance with actual measurement data in the case where directivity is made omnidirectivity in the present invention.
Figure 9B:
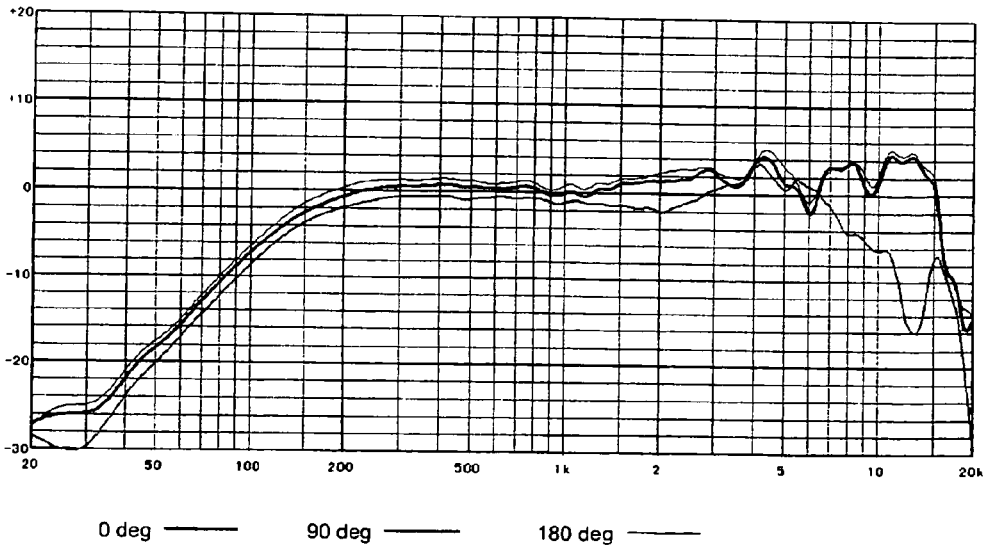
FIG. 9B is a graph showing the directional frequency response of FIG. 9A.

FIGS. 5A and 5B are graphs showing the polar pattern and the directional frequency response thereof in the case of bidirectivity. FIGS. 6A and 6B are graphs showing the polar pattern and the directional frequency response thereof in the case of hypercardioid. FIGS. 7A and 7B are graphs showing the polar pattern and the directional frequency response thereof in the case of cardioid. FIGS. 8A and 8B are graphs showing the polar pattern and the directional frequency response thereof in the case of subcardioid. FIGS. 9A and 9B are graphs showing the polar pattern and the directional frequency response thereof in the case of omnidirectivity.

As seen from these graphs, in the present invention, in which the rear air chamber 1*b* is used in common by the front-side unit 1F and the rear-side unit 1R, it is recognized that even if any directivity is selected, as a peculiar effect, the frequency characteristics of the front (0-degree direction) do not change greatly.

The invention claimed is:

1. A variable directional microphone, comprising:

a unidirectional first dynamic microphone unit, and a unidirectional second dynamic microphone unit which has the same configuration as that of the first dynamic microphone unit and is provided with an output adjusting device of sound signal, the first and second dynamic microphone units being provided as a pair, wherein each of the first and second dynamic microphone units has an electrokinetic acousto-electric converter, and a rear air chamber with a predetermined capacity acoustically connected to a rear portion of the electrokinetic acousto-electric converter, the first and second dynamic microphone units are arranged coaxially so that directivity axes thereof are directed to directions 180° opposite to each other, and output signals of the dynamic microphone units are generated via a signal synthesis circuit, the rear portions of the first and second electrokinetic acousto-electric converters are sealingly connected together by a connecting cylinder, one rear air chamber which is used in common by the first and second dynamic microphone units and has a capacity same as the predetermined capacity is provided in the connecting cylinder between the rear portions of the first and second dynamic microphone units, and the rear air chamber is arranged on an outside between the dynamic microphone units via a predetermined tube member.

2. A variable directional microphone, consisting of:

a unidirectional first dynamic microphone unit, a unidirectional second dynamic microphone unit having same configuration as that of the first dynamic microphone unit and including an output adjusting device of sound signal, wherein the first and second dynamic microphone units are provided as a pair and have electrokinetic acousto-electric converters, a connecting cylinder having two ends opposite to each other, wherein rear portions of the first and second electrokinetic acousto-electric converters are sealingly connected to the two ends so that directivity axes thereof are same and directed 180° opposite to each other, and output signals of the dynamic microphone units are generated via a signal synthesis circuit, and one rear air chamber having a predetermined capacity and acoustically connected to the rear portions of the first and second electrokinetic acousto-electric converters, wherein the one rear air chamber is common to the first and second dynamic microphone units and the predetermined capacity has a capacity required to each of the first and second electrokinetic acousto-electric converters, wherein said connecting cylinder has a tube part connected to a middle portion thereof, and an air chamber housing disposed at a side of the connecting cylinder and connected to the tube part, the air chamber forming the one rear air chamber.

* * * * *